US011499115B2

(12) United States Patent
Champagne et al.

(10) Patent No.: US 11,499,115 B2
(45) Date of Patent: Nov. 15, 2022

(54) LUBRICANT COMPOSITION

(71) Applicants: TOTAL MARKETING SERVICES, Puteaux (FR); Dow Global Technologies LLC, Midland, MI (US)

(72) Inventors: Nicolas Champagne, Caluire (FR); Nadjet Khelidj, Zurich (CH)

(73) Assignees: TOTAL MARKETING SERVICES, Puteaux (FR); DOW GLOBAL TECHNOLOGIES LLC, Midland, MI (US)

( * ) Notice: Subject to any disclaimer, the term of this patent is extended or adjusted under 35 U.S.C. 154(b) by 0 days.

(21) Appl. No.: 16/344,276

(22) PCT Filed: Oct. 23, 2017

(86) PCT No.: PCT/EP2017/076958
§ 371 (c)(1),
(2) Date: Apr. 23, 2019

(87) PCT Pub. No.: WO2018/077780
PCT Pub. Date: May 3, 2018

(65) Prior Publication Data

US 2019/0270945 A1 Sep. 5, 2019

(30) Foreign Application Priority Data

Oct. 24, 2016 (FR) ..... 1660274

(51) Int. Cl.

| | |
|---|---|
| ***C10M 145/34*** | (2006.01) |
| ***C10M 111/04*** | (2006.01) |
| *C10N 20/02* | (2006.01) |
| *C10N 20/04* | (2006.01) |
| *C10N 30/02* | (2006.01) |
| *C10N 30/06* | (2006.01) |
| *C10N 30/08* | (2006.01) |
| *C10N 30/10* | (2006.01) |
| *C10N 30/00* | (2006.01) |
| *C10N 40/04* | (2006.01) |

(52) U.S. Cl.
CPC ..... *C10M 145/34* (2013.01); *C10M 111/04* (2013.01); *C10M 2209/106* (2013.01); *C10M 2209/1065* (2013.01); *C10N 2020/02* (2013.01); *C10N 2020/04* (2013.01); *C10N 2030/02* (2013.01); *C10N 2030/06* (2013.01); *C10N 2030/08* (2013.01); *C10N 2030/10* (2013.01); *C10N 2030/54* (2020.05); *C10N 2030/68* (2020.05); *C10N 2040/04* (2013.01)

(58) Field of Classification Search
CPC ..... C10M 145/34; C10M 111/04; C10M 2209/1065; C10M 2209/106; C10N 2020/02; C10N 2020/04; C10N 2030/02; C10N 2030/06; C10N 2030/08; C10N 2030/10; C10N 2030/54; C10N 2030/68; C10N 2040/04
See application file for complete search history.

(56) References Cited

U.S. PATENT DOCUMENTS

| | | | | |
|---|---|---|---|---|
| 5,053,154 | A * | 10/1991 | Oppenlaender ..... | C10M 107/34 508/562 |
| 2012/0108482 | A1 | 5/2012 | Greaves | |
| 2014/0194332 | A1* | 7/2014 | Kamata ..... | C10M 111/04 508/532 |
| 2014/0303053 | A1 | 10/2014 | Greaves | |
| 2015/0119303 | A1 | 4/2015 | Guerin et al. | |
| 2015/0275124 | A1 | 10/2015 | Greaves | |
| 2015/0284657 | A1 | 10/2015 | Ma et al. | |
| 2016/0024412 | A1 | 1/2016 | Kashani et al. | |
| 2017/0335232 | A1* | 11/2017 | Kaneko ..... | C08G 65/34 |

FOREIGN PATENT DOCUMENTS

| | | | |
|---|---|---|---|
| CN | 102471720 | A | 5/2012 |
| CN | 102959066 | A | 3/2013 |
| CN | 103890152 | A | 6/2014 |
| CN | 103890154 | A | 6/2014 |
| CN | 104364357 | A | 2/2015 |
| CN | 104 403 741 | | 3/2015 |
| CN | 104822813 | A | 8/2015 |
| CN | 104903429 | A | 9/2015 |
| CN | 104945613 | A | 9/2015 |
| CN | 105683290 | A | 6/2016 |
| EP | 376236 | A * | 7/1990 |
| EP | 0376236 | A1 | 7/1990 |
| EP | 2 395 068 | | 12/2011 |

(Continued)

OTHER PUBLICATIONS

International Search report, PCT/EP2017/076958, dated Dec. 6, 2017.
French Search Report, FR 1660274, dated May 5, 2017.
"UCON OSP base Fluids—Oil-soluble polyalkylene glycol lubncant technology", Apr. 1, 2013 (Apr. 1, 2013). pp. 1-4. XP055209380, Retrieved from the Internet: URL:http://msdssearch.dow.com/PublishedLiteratureDOWCOM/dh 06de/0901b803806deb46.pdf?filepath-ucon/pdfs/noreg/816-00056.pdf&fromPage-GetDoc [retrieved on Aug. 25, 2015].

*Primary Examiner* — Taiwo Oladapo
(74) *Attorney, Agent, or Firm* — Nixon & Vanderhye

(57) ABSTRACT

Disclosed is a lubricant composition including: at least one base oil; at least one polyalkylene glycol with at least 50% by weight of butylene oxide units and having a kinematic viscosity, measured at 100° C. according to standard ASTM D445 (2015), which is greater than or equal to 50 mm2/s, a kinematic viscosity, measured at 40° C. according to standard ASTM D445 (2015), which is greater than or equal to 1000 mm2/s and a Viscosity Index, measured according to standard ASTM D2270 (2012), which is greater than or equal to 180. Also disclosed is the use of such a composition for transmission or gear lubrication.

12 Claims, No Drawings

(56) References Cited

FOREIGN PATENT DOCUMENTS

| | | | | |
|---|---|---|---|---|
| WO | 2011/050150 | A1 | 4/2011 | |
| WO | WO-2016072302 | A1 * | 5/2016 | ..... C08G 65/34 |

* cited by examiner

LUBRICANT COMPOSITION

The present application relates to the field of lubricant compositions, in particular engine lubricant compositions, especially for motor vehicle engines, transmissions and gearing. More particularly, the present application relates to the field of lubricant compositions for transmissions and gearing.

Lubricant compositions for transmissions (for example gearboxes or differential housings) or for gearing, in particular for industrial gearing, must satisfy many requirements, in particular related to driving comfort (smooth gear shift, quiet running, trouble-free operation, high reliability), to the service life of the assembly (reduction of wear during cold gear shift, no deposits and high thermal stability, safety of lubrication at high temperatures, stable viscosity condition and absence of shear loss, long service life) as well as to consideration of environmental aspects (lower fuel consumption, reduced lubricant consumption, low noise, easy drainage). These comprise, in particular, requirements for lubricant compositions for manual gearboxes and axle gearing. Concerning the requirements imposed on the automatic gearbox oils (ATF), they are very specific and relate in particular to high constancy of the coefficient of friction during all its life for an optimal gearshift, excellent aging stability for long drainage intervals, good viscosity-temperature performance to ensure perfect operation with a hot engine as well as a cold engine, and sufficient sealing compatibility with the various elastomers used in the transmission seals so that they do not swell, do not shrink, and do not become fragile. Moreover, in the automotive field, the search for the reduction of $CO_2$ emissions requires the development of products that reduce friction in gearboxes and differential housings. This reduction of friction in gearboxes and in differential housings must be achieved under different operating conditions. This reduction of friction must cover the internal friction of the lubricant but also the friction of the elements constituting the gearboxes or differential housings, in particular the metal elements.

(Poly)alkylmethacrylate (PAMA) are conventionally used for their very good viscosity index but have a low shear stability. In addition, PAMA are expensive.

Polyalphaolefins (PAO) are also used because they have good shear stability, but their viscosity index contribution is low.

There is therefore an interest in providing a solution offering good viscosity and good shear stability.

One object of the present invention is thus to provide a lubricant composition, especially for transmissions and gearing, offering a compromise between the viscosity index and shear stability.

Another object of the present invention is also to provide a composition which offers viscosity stability as a function of temperature, i.e. a good viscosity index.

Yet another object of the present invention is to provide such a composition for fuel economy.

Still other objects become apparent upon reading the description of the invention which follows.

These objectives are fulfilled by the present application which relates to a lubricant composition comprising:

at least one base oil;

at least one polyalkylene glycol (PAG), comprising at least 50% by weight of butylene oxide units and propylene oxide units, having a kinematic viscosity, measured at 100° C. according to the standard ASTM D445 (2015), greater or equal to 50 $mm^2/s$, a kinematic viscosity, measured at 40° C. according to the standard ASTM D445 (2015), greater than or equal to 500 $mm^2/s$, more particularly greater than or equal to 1000 $mm^2/s$, and a viscosity index, measured according to the standard ASTM D2270 (2012), greater than or equal to 160, preferably greater than or equal to 180, even more preferably greater than or equal to 200.

Preferably, the present invention relates to a lubricant composition comprising:

at least one base oil;

at least one polyalkylene glycol (PAG), comprising at least 50% by weight of butylene oxide units, and preferably comprising only butylene oxide units, having a kinematic viscosity, measured at 100° C. according to the standard ASTM D445 (2015), greater than or equal to 50 $mm^2/s$, a kinematic viscosity, measured at 40° C. according to the standard ASTM D445 (2015), greater than or equal to 1000 $mm^2/s$, and a viscosity index, measured according to the standard ASTM D2270 (2012), greater than or equal to 180.

It should be understood in the context of the present invention that the base oil and the PAG are two distinct compounds.

Preferably, the PAG of the invention comprises at least 80% by weight of butylene oxide units and propylene oxide units. Even more preferably, the PAG of the invention is a PAG whose alkylene units are solely butylene oxide units.

The PAG of the invention is therefore described as a PAG whose alkylene oxide units are chosen from butylene oxide units and propylene oxide units with at least 50% by weight, preferably at least 80% by weight, and even more preferably 100% by weight, of butylene oxide units.

According to a preferred embodiment, the PAG of the invention comprises 100% by weight of butylene oxide units.

Particularly advantageously, the PAG of the invention is soluble in the base oil, advantageously at whatever temperature.

Preferably, the PAG is obtained by polymerization or copolymerization of butylene oxides. In particular, the PAG of the invention may be prepared according to the known methods described especially in US20120108482 and, in particular, by reaction of one or more alcohols comprising from 2 to 12 carbon atoms, in particular polyol, preferably diol, with butylene oxide and propylene oxide. The alcohols are in particular diols and, preferably, 1,2-propanediol. The butylene oxide may be selected from 1,2-butylene oxide or 2,3-butylene oxide, preferably 1,2-butylene oxide. In the case where the PAG comprises only butylene oxide units, the method described in US20120108482 is adapted to the implementation of butylene oxide alone.

According to one embodiment, the PAG is obtained by reaction of one or more polyols comprising from 2 to 12 carbon atoms, preferably diol, with butylene oxides.

Preferably, the PAG of the invention comprises from 25 to 300 moles of butylene oxide units, preferably from 50 to 200 moles.

Preferably, the PAG of the invention comprises an O/C ratio (oxygen atom/carbon atom) by weight between 0.29 and 0.38, preferably between 0.29 and 0.35.

Preferably, the PAG of the invention has a molar mass of between 5,000 and 200,000 g/mol.

Preferably, the PAG of the invention has a kinematic viscosity, measured at 100° C. according to the standard ASTM D445 (2015), of between 50 and 500 $mm^2/s$, a kinematic viscosity, measured at 40° C. according to the standard ASTM D445 (2015), between 500 and 4000 $mm^2/s$, and a viscosity index, measured according to the standard ASTM D2270 (2012), between 160 and 300.

Preferably, the PAG of the invention, in particular comprising 100% by weight of butylene oxide units, has a kinematic viscosity, measured at 40° C. according to the standard ASTM D445 (2015), of between 1000 and 4500 $mm^2/s$, preferably between 1000 and 4250 $mm^2/s$, and more preferably between 1100 and 4250 $mm^2/s$.

Preferably, the PAG of the invention, in particular comprising 100% by weight of butylene oxide units, has a viscosity index, measured according to the standard ASTM D2270 (2012), of between 180 and 300, preferably between 200 and 300.

According to a particularly preferred embodiment, the PAG has a kinematic viscosity measured at 100° C. according to the standard ASTM D445 (2015) of between 50 and 500 $mm^2/s$, a kinematic viscosity measured at 40° C. according to the standard ASTM D445 (2015). between 1000 and 4500 $mm^2/s$, and a viscosity index measured according to the standard ASTM D2270 (2012) between 180 and 300.

Preferably, the lubricant composition of the invention comprises at most 30% by weight of PAG, preferably from 2% to 30% by weight of PAG, more preferably from 2% to 15% relative to the total weight of the lubricant composition.

Preferably, the lubricant composition of the invention comprises at most 30% by weight of PAG, preferably from 6% to 30% by weight of PAG, more preferably from 9% to 16% relative to the total weight of the lubricant composition.

The lubricant composition used according to the invention comprises at least one base oil. In general, the lubricant composition used according to the invention may comprise any type of mineral, synthetic or natural lubricating base oil, animal or vegetable, known to those skilled in the art.

The base oils used in the lubricant compositions according to the invention may be oils of mineral or synthetic origin belonging to groups I to V according to the classes defined in the API classification (or their equivalents according to the ATIEL classification) (Table A) or their mixtures.

TABLE A

| | Saturated content | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Polyalphaolefins (PAO) | | |
| Group V | Esters and other bases not included in groups I to IV | | |

The mineral base oils according to the invention include all types of base oils obtained by atmospheric and vacuum distillation of crude oil, followed by refining operations such as solvent extraction, desalphating, solvent dewaxing, hydrotreatment, hydrocracking, hydroisomerization and hydrofinition.

Mixtures of synthetic and mineral oils may also be used.

There is generally no limitation as to the use of different lubricating bases for producing the lubricant compositions used according to the invention, except that they must have properties, in particular of viscosity, oxidation resistance, that are adapted for use for vehicle engines or for transmissions.

The base oils of the lubricant compositions used according to the invention may also be chosen from synthetic oils, such as certain carboxylic acid esters and alcohols, and from polyalphaolefins (PAO). The polyalphaolefins used as base oils are, for example, obtained from monomers comprising from 4 to 32 carbon atoms, for example from octene or decene, with a viscosity at 100° C. is between 1.5 and 15 $mm^2/s^{-1}$ according to the standard ASTM D445 (2015). Their average molecular weight is generally between 250 and 3000 according to the standard ASTM D5296.

Preferably, the base oils of the present invention are chosen from the above base oils whose aromatic content is between 0 and 45%, preferably between 0 and 30%. The aromatic content of the oils is measured according to UV Burdett method.

Advantageously, the lubricant composition used according to the invention comprises at least 50% by weight of base oils relative to the total weight of the composition.

More advantageously, the lubricant composition used according to the invention comprises at least 60% by weight, or even at least 70% by weight, of base oils relative to the total weight of the composition.

More particularly advantageously, the lubricant composition used according to the invention comprises from 60 to 99.5%, preferably from 70 to 99.5%, more preferably from 70 to 98% by weight of base oils relative to the total weight of the composition.

Many additives may be used for this lubricant composition according to the invention.

The preferred additives for the lubricant composition used according to the invention are chosen from friction modifiers, detergents, anti-wear additives, extreme pressure additives, viscosity index improvers, dispersants, antioxidants, pour point improvers, defoamers, thickeners and mixtures thereof.

Preferably, the lubricant composition used according to the invention comprises at least one antiwear additive, and at least one extreme pressure additive, or their mixtures. Anti-wear additives and extreme pressure additives protect friction surfaces by forming a protective film that is adsorbed on these surfaces. There is a wide variety of anti-wear additives. In a preferred manner for the lubricant composition according to the invention, the anti-wear additives are chosen from among phosphosulfur additives such as metal alkylthiophosphates, in particular zinc alkylthiophosphates, and, more specifically, zinc dialkyldithiophosphates (ZnDTP). The preferred compounds have the formula $Zn((SP(S)(OR^2)(OR^3))_2$, in which $R^2$ and $R^3$, which may be identical or different, independently represent an alkyl group, preferably an alkyl group comprising from 1 to 18 carbon atoms. Amine phosphates are also anti-wear additives which may be used in the lubricant composition according to the invention However, the phosphorus provided by these additives can act as a poison for the catalytic systems of automobiles because these additives are ash generators. These effects may be minimized by partially replacing the amine phosphates with non-phosphorus additives, such as, for example, polysulfides, especially sulfur-containing olefins, which may comprise from 0.01 to 6% by weight, preferably from 0.05 to 4% by weight, more preferably from 0.1 to 2% by weight relative to the total weight of lubricant composition, anti-wear additives and extreme pressure additives.

Advantageously, the lubricant composition according to the invention may comprise at least one friction-modifying additive. The friction-modifying additive may be chosen from a compound providing metal elements and an ash-free compound. Among the compounds providing metal elements, mention may be made of transition metal complexes such as Mo, Sb, Sn, Fe, Cu and Zn, the ligands of which may be hydrocarbon compounds comprising oxygen, nitrogen, sulfur or phosphorus. The ashless friction-modifying additives are generally of organic origin and may be selected from among monoesters of fatty acids and polyols, alkoxylated amines, alkoxylated fatty amines, fatty epoxides, borate fatty epoxides; fatty amines or fatty acid glycerol esters. According to the invention, the fatty compounds comprise at least one hydrocarbon group comprising from 10 to 24 carbon atoms. Advantageously, the lubricant composition according to the invention may comprise from 0.01 to 2% by weight, or from 0.01 to 5% by weight, preferably from 0.1 to 1.5% by weight, or more preferably 0.1 at 2% by weight relative to the total weight of the lubricant composition and friction-modifying additive.

Advantageously, the lubricant composition according to the invention may comprise at least one antioxidant additive. The antioxidant additive generally serves to retard the degradation of the lubricant composition in service. This degradation may result, in particular, in the formation of deposits, the presence of sludge or an increase in the viscosity of the lubricant composition. Antioxidant additives act in particular as radical inhibitors or destroyers of hydroperoxides. Among the antioxidant additives commonly used, mention may be made of antioxidant additives of the phenolic type, antioxidant additives of the amine type, or antioxidant phosphosulfur additives. Some of these antioxidant additives, for example phosphosulfur antioxidant additives, may be ash generators. Phenolic antioxidant additives may be ash-free or may be in the form of neutral or basic metal salts. The antioxidant additives may, in particular, be chosen from among sterically hindered phenols, sterically hindered phenol esters and sterically hindered phenols comprising a thioether bridge, diphenylamines, diphenylamines substituted with at least one $C_1$-$C_{12}$ alkyl group, and N,N'-dialkyl-aryl diamines and mixtures thereof. Preferably, according to the invention, the sterically hindered phenols are chosen from among compounds comprising a phenol group in which at least one vicinal carbon of the carbon bearing the alcohol function is substituted by at least one $C_1$-$C_{10}$ alkyl group, preferably a $C_1$-$C_6$ alkyl group, more preferably a $C_4$ alkyl group, even more preferably by the ter-butyl group. Amino compounds are another class of antioxidant additives that may be used, optionally in combination with phenolic antioxidant additives. Examples of amine compounds are aromatic amines, for example aromatic amines of the formula $NR^4R^5R^6$ in which $R^4$ represents an optionally substituted aliphatic or aromatic group, $R^5$ represents an optionally substituted aromatic group, $R^6$ represents a hydrogen atom, an alkyl group, an aryl group or a group of the formula $R^7S(O)_zR^8$ in which $R^7$ represents an alkylene group or an alkenylene group, $R^8$ represents an alkyl group, an alkenyl group or an aryl group and z represents 0, 1 or 2. Sulfurized alkyl phenols or their alkali and alkaline earth metal salts may also be used as antioxidant additives. Another class of antioxidant additives is that of copper compounds, for example copper thio- or dithiophosphates, copper and carboxylic acid salts, dithiocarbamates, sulphonates, phenates, copper acetylacetonates. Copper salts I and II, succinic acid or anhydride salts may also be used. The lubricant composition according to the invention may contain all types of antioxidant additives known to those skilled in the art. Advantageously, the lubricant composition comprises at least one ash-free antioxidant additive. Also advantageously, the lubricant composition according to the invention comprises from 0.5 to 2% by weight of at least one antioxidant additive relative to the total weight of the composition.

The lubricant composition according to the invention may also comprise at least one detergent additive. The detergent additives generally make it possible to reduce the formation of deposits on the surface of the metal parts by dissolving the secondary oxidation and combustion products. The detergent additives that may be used in the lubricant composition according to the invention are generally known to those skilled in the art. The detergent additives may be anionic compounds comprising a long lipophilic hydrocarbon chain and a hydrophilic head. The associated cation may be a metal cation of an alkali metal or alkaline earth metal. The detergent additives are preferably chosen from the alkali metal or alkaline earth metal salts of carboxylic acids, the sulphonates, the salicylates, the naphthenates and the phenate salts. The alkali and alkaline earth metals are preferably calcium, magnesium, sodium or barium. These metal salts generally comprise the metal in stoichiometric amount or in excess, therefore in an amount greater than the stoichiometric amount. These are then overbased detergent additives; wherein the excess metal bringing the overbased character to the detergent additive is then generally in the form of an oil-insoluble metal salt, for example a carbonate, a hydroxide, an oxalate, an acetate, a glutamate, preferably a carbonate. Advantageously, the lubricant composition according to the invention may comprise from 0.5 to 4% by weight of detergent additive relative to the total mass of the lubricant composition.

Also advantageously, the lubricant composition according to the invention may also comprise at least one pour point depressant additive. By slowing the formation of paraffin crystals, pour point depressant additives generally improve the cold behavior of the lubricant composition according to the invention. As examples of pour point depressant additives, mention may be made of alkyl polymethacrylates, polyacrylates, polyarylamides, polyalkylphenols, polyalkylnaphthalenes and alkylated polystyrenes.

Advantageously, the lubricant composition according to the invention may also comprise at least one dispersing agent. The dispersing agent may be chosen from among Mannich bases, succinimides and their derivatives. Also advantageously, the lubricant composition according to the invention may comprise from 0.2 to 10% by weight of dispersing agent relative to the total weight of the lubricant composition.

The lubricant composition of the present invention may also comprise at least one viscosity index improving additive. Examples of additives improving the viscosity index include polymeric esters, homopolymers or copolymers, hydrogenated or non-hydrogenated, styrene, butadiene and isoprene, polyacrylates, polymethacrylates (PMA) or alternatively olefin copolymers, in particular ethylene/propylene copolymers.

The lubricant composition according to the invention may be in various forms. The lubricant composition according to the invention may, in particular, be an anhydrous composition. Preferably, this lubricant composition is not an emulsion.

Preferably, the base oil of the composition according to the invention is chosen from group II oils and group III oils as defined above.

Preferably, the base oil of the composition according to the invention comprises at least one polyalphaolefin (PAO) as described above, in particular an alkene oligomer whose final viscosity is between 2 and 500 cSt.

Preferably, the base oil of the composition according to the invention is chosen from among group II oils and group III oils as defined above and at least one polyalphaolefin (PAO) as described above.

Advantageously, the lubricant composition according to the invention has excellent shear stability. The shear stability may, in particular, be determined from the kinematic viscosities before and after a shearing process according to the KRL 20 h test according to the standard CEC-L-45-A-99 (2014). Advantageously, the shear loss is less than 5%.

Advantageously, the lubricant composition according to the invention has low traction coefficients. The traction coefficient is determined by Mini Traction Machine (MTM) sold by PCS Instruments. The operating conditions observed are a temperature of 40° C. under a load of 75N and a disk speed of 1 m/s for an SRR sliding-rolling ratio of 20%.

Advantageously, the lubricant composition according to the invention has a temperature-stable viscosity.

Advantageously, the lubricant composition according to the invention allows a gain in fuel economy.

Advantageously, the lubricant composition according to the invention retains satisfactory anti-wear properties.

Advantageously, the lubricant composition according to the invention allows a performance gain for the cold properties.

The lubricant composition of the invention is particularly useful for the lubrication of motor vehicle transmission components, especially transmissions for light or heavy vehicles, for example gearboxes, differentials, preferably manual gearboxes and heavy vehicle differentials; or for gears, especially industrial gears. Thus, the present invention relates to the use of a lubricant composition according to the invention for the lubrication of the transmission members of motor vehicles, in particular the transmissions for light or heavy vehicles, for example gearboxes, differentials, preferably gearboxes, differentials, preferably manual gearboxes and heavy vehicle differentials; or for gears, in particular industrial gears. Preferably, any type of grade 70 W and 75 W is suitable for lubricants for transmission members.

The present invention also relates to a method of lubricating at least one mechanical part of a transmission member of motor vehicles, especially transmission for light or heavy vehicles, for example gearboxes, differentials, preferably manual gearboxes and heavy vehicle differentials; or for gears, especially industrial gears, wherein the method comprises at least one step in which the mechanical part is brought into contact with at least one lubricant composition according to the invention.

The lubricant composition according to the present invention may also be used for engine lubrication, particularly motor vehicle engines and preferably for SAE 0W-8, 0W-12 and 0W-16 grades.

The invention also relates to the use of the lubricant composition according to the invention for reducing the traction coefficient of vehicle engine oil.

The invention also relates to the use of the lubricant composition according to the invention for reducing the fuel consumption of a vehicle equipped with a differential or a gearbox lubricated with this composition.

The invention also relates to the use of the lubricant composition according to the invention for reducing the fuel consumption of a vehicle equipped with a transmission lubricated with this composition.

The invention also relates to the use of the lubricant composition according to the invention for reducing the traction coefficient of a transmission oil, in particular a gearbox oil or a differential oil.

The present application also relates to the use of at least one PAG as defined above in a lubricant composition, in particular for transmission members of motor vehicles or gears, in particular industrial gears, for increasing the viscosity index of the lubricant composition, while providing shear stability of the lubricant composition.

The present application will now be described using non-limiting examples.

EXAMPLES

Description of the PAG according to the invention implemented in the examples:

TABLE 1

| | Kinematic viscosity measured at 100° C. according to ASTM D445 (2015) ($mm^2/s$) | Kinematic viscosity measured at 40° C. according to ASTM D445 (2015) (2015) ($mm^2/s$) | Viscosity index measured according to ASTM D2270 (2012) |
|---|---|---|---|
| PAG1 | 130 | 1140 | 221 |
| PAG2 | 127 | 1130 | 219 |
| PAG3 | 437 | 4230 | 279 |

Lubricant Compositions According to the Invention:

The lubricant compositions were formulated with PAG of the invention in order to have a kinematic viscosity at 100° C. of about 7.5 $mm^2/s$, wherein these compositions are described in Table 2 below.

TABLE 2

| | CL1 (% weight) | CL2 (% weight) | CL3 (% weight) |
|---|---|---|---|
| Base oil (mixture of a Group III base oil with a kinematic viscosity at 40° C. equal to 12 $mm^2/s$ and a Group III base oil with a kinematic viscosity at 40° C. equal to 19 $mm^2/s$) | 71.97 | 76.91 | 77.27 |
| PAG1 | — | 14.54 | — |
| PAG2 | — | — | 14.18 |
| Additives | 8.55 | 8.55 | 8.55 |
| Viscosity at 100° C. ($mm^2/s$) according to ASTM D445 (2015) | 7.57 | 7.56 | 7.59 |
| Viscosity at 40° C. ($mm^2/s$) according to ASTM D445 (2015) | 37.7 | 36.5 | 36.6 |
| Viscosity index according to ASTM D2270 (2012) | 174 | 182 | 183 |

Comparative Lubricant Compositions:

The following comparative compositions were formulated to have a kinematic viscosity at 100° C. of about 7.5 $mm^2/s$, wherein these compositions are described in Table 3 below. The base oil and additives are identical to those of compositions CL2 and CL3.

TABLE 3

| | CC1 (% weight) | CC2 (% weight) |
|---|---|---|
| Base oil | 80.45 | 74.84 |
| Ethylene/propylene copolymer | 5 | |

TABLE 3-continued

| | CC1 (% weight) | CC2 (% weight) |
|---|---|---|
| PAMA (Viscoplex 0-130 ®) | 6 | |
| PAMA (Viscobase 11-522 ®) | | 16.61 |
| Additives | 8.55 | 8.55 |
| Viscosity at 100° C. ($mm^2/s$) according to ASTM D445 (2015) | 7.4 | 7.6 |
| Viscosity at 40° C. ($mm^2/s$) according to ASTM D445 (2015) | 35 | 38.2 |
| Viscosity index according to ASTM D2270 (2012) | 183 | 172 |

Evaluation of Performances of Compositions

The performances of the lubricant compositions CL2, CL3, CC1 and CC2 were determined according to the following methods:

Cold properties by Brookfield measurement at −40° C. according to ASTM D2983 (2015), Wear according to ISO14635-3 (2005), The shear stability determined by the loss of viscosity of the lubricant composition after a shearing process KRL 20 h according to the standard CEC-L-45-A-99 (2014), The thermo-oxidative stability measured by DKA according to the standard CEC L-48-A-00 (2014), The viscosity index according to ISO2909 (2014).

TABLE 4

| | Viscosity index according to ASTM D2270 | Cold properties Brookfield (−40° C.) mPa · s | Wear FZG 6 level | Shear stability KRL 20 h Viscosity Loss (%) | Thermo-oxidative stability DKA Viscosity variation (40° C.) $mm^2/s$ (%) | Viscosity variation (100° C.) $mm^2/s$ (%) | PAI (Peak Area Increase) |
|---|---|---|---|---|---|---|---|
| CL2 | 182 | 23300 | 10 | 3 | 17 | 8 | 75 |
| CL3 | 183 | 22900 | 8 | 3.1 | 8 | 7 | 80 |
| CC1 | 183 | 40000 | 10 | 7 | 15 | 14 | 46 |
| CC2 | 172 | 16700 | 7 | 4.5 | 14 | 12 | 82 |

It appears that the viscosity temperature (VI) dependence is improved with respect to the CC2 reference for PAG of sufficient viscosity.

These results also show that the compositions according to the invention have a good Brookfield viscosity, which is improved with respect to the CC1 reference.

The shear stability is excellent. It can be seen that the solution of the invention, although more viscous, shears less than the Viscobase 11-522® during this test, despite the fact that the PAG tested are more viscous than the Viscobase 11-522®.

Evaluation of the Traction Coefficients Under Different Conditions

In order to evaluate the fuel economy potential of our solution, lubricant compositions with different viscosity index improvers were prepared and are described in Table 5 below. These compositions were made in order to have a similar kinematic viscosity at 100° C.

The base oil and the additives are identical to those of the above compositions.

TABLE 5

| | CC3 | CL4 | CL5 |
|---|---|---|---|
| Base oils | 76.95 | 78.37 | 83.5 |
| Additives | 7.25 | 7.25 | 7.25 |
| Viscoplex Polymer 0-130 ® | 14.5 | | |
| PAG 1 | | 14.38 | |
| PAG 3 | | | 9.25 |

The traction coefficient (TC) was measured using the PCS Instruments' MTM tribometer. The measurement conditions were 75N load and the disk speed was 1 m/s at an evaluated temperature (40° C.) and an SRR of 20%. The results are shown in Table 6 below.

TABLE 6

| | CC3 | CL4 | CL5 |
|---|---|---|---|
| Viscosity at 100° C. ($mm^2/s$) according to ASTM D445 | 7.61 | 7.50 | 7.30 |
| Viscosity index according to ASTM D2270 | 204 | 186 | 194 |
| TC (40° C., 20% SRR) | 0.0516 | 0.0501 | 0.0493 |

Thus, the lubricant compositions according to the invention CL4 and CL5 make it possible to lower the traction coefficient, wherein the reproducibility of the test is of the order of 3%.

This reduction in the traction coefficient is particularly interesting in that it leads to an increase in the fuel economy.

Evaluation of the Fuel Savings Eco

The composition CL6 and the comparative composition CC4 below were used for this evaluation.

| Composition | CL6 | CC4 |
|---|---|---|
| Composition CL6 AC4 base oil (mixture of a Group III base oil with a kinematic viscosity at 40° C. equal to 12 $mm^2/s$ and a Group III base oil with a kinematic viscosity at 40° C. equal to 19 $mm^2/s$) | 86.2 | 85.6 |
| Viscoplex Polymer 3-200 ® | 0 | 3.3 |
| PAG 4 | 2.7 | 0 |
| Friction modifier | 0.7 | 0.7 |
| Package of additive 1 | 10.4 | 10.4 |
| Viscosity at 100° C. ($mm^2/s$) according to ASTM D445 | 4.13 | 4.83 |
| Viscosity at 40° C. ($mm^2/s$) according to ASTM D445 | 17.47 | 17.86 |
| Viscosity index according to ASTM D2270 | 144 | 214 |

The friction modifier is a conventional organomolybdenum compound commercially available from Adeka under the trade name "Sakuralube®", The conventional additive package 1 comprises a dispersant, detergents and an anti-wear additive.

The test procedure is as follows:

Characterization of the Compositions According to the Invention and Comparative in Terms of Fuel Economy.

The test is carried out using a Honda L13-B engine, whose power is 81 kW at 5,500 rpm, driven by an electric generator imposing a rotation speed of between 650 and 5,000 rpm, while a torque sensor can measure the friction torque generated by the movement of the parts in the engine. The friction torque induced by the test lubricant is compared for each speed and each temperature of the torque induced by the reference lubricant composition (SAE 0W8), in this case CC4.

The conditions of this test are as follows.

The tests are carried out according to the following sequence:

rinsing the engine with a rinsing oil comprising detergent additives, followed by rinsing with a reference lubricant composition;

measuring the friction torque on the engine using the reference lubricant composition at the four different temperatures indicated below;

rinsing the engine with a rinsing oil comprising detergent additives, followed by rinsing with a lubricant composition to be evaluated;

measuring the friction torque on the engine using the lubricant composition to be evaluated at four different temperatures;

rinsing the engine with a rinsing oil comprising detergent additives, followed by rinsing with the reference lubricant composition; and measuring the friction torque on the engine using the reference lubricant composition at the four different temperatures indicated below.

The speed ranges, the variation of the speed as well as the temperature were chosen to cover, in the most representative way possible, the points of the NEDC certified cycle.

The instructions implemented are a follows:

Engine outlet water temperature: 35° C./50° C./80° C./90° C.±0.5° C.,

Oil temperature ramp: 35° C./50° C./80° C./90° C.±0.5° C.

The friction gain is evaluated for each lubricant composition (CL) as a function of engine temperature and speed and in comparison with the friction of the reference lubricant composition.

The results of the fuel economy test are summarized in the following table, and indicate the percentage averages of the friction gains for each composition at a given temperature over a speed range of 650 rpm to 5,000 rpm. with respect to the fuel economy results obtained with the reference composition CC4:

| Average percentage friction gain at a temperature T of the lubricating composition | CL6 |
|---|---|
| T = 35° C. | 0.29% |
| T = 50° C. | 0.92% |

-continued

| Average percentage friction gain at a temperature T of the lubricating composition | CL6 |
|---|---|
| T = 80° C. | 1.33% |
| T = 90° C. | 1.71% |

These results demonstrate that the friction gains for the CL6 composition according to the invention are much greater than the friction gains obtained with the reference composition CC4.

It is to be understood that the greater the friction gains, the greater is the fuel economy. This therefore implies that the compositions according to the invention make it possible to increase the fuel economy in contrast to the compositions comprising no PAG according to the invention.

The invention claimed is:

1. Method for reducing traction coefficient comprising lubricating at least one mechanical part of a transmission member of motor vehicles or industrial gears with at least one lubricant composition comprising:

at least one base oil;

at least one polyalkylene glycol (PAG) comprising at least 50% by weight of butylene oxide units and having a kinematic viscosity measured at 100° C. according to ASTM D445 (2015) greater than or equal to 50 $mm^2/s$, a kinematic viscosity measured at 40° C. according to ASTM D445 (2015) greater than or equal to 1000 $mm^2/s$, and a viscosity index measured according to ASTM D2270 (2012) greater than or equal to 180, wherein the PAG is obtained by reaction with butylene oxides of one or more polyols comprising 2 to 12 carbon atoms, and wherein the PAG comprises an O/C ratio (oxygen atom/carbon atom) weight/weight between 0.29 and 0.38.

2. The method according to claim 1, wherein the PAG comprises from 25 to 300 moles of butylene oxide units.

3. The method according to claim 1, wherein the PAG comprises at least 80% by weight of butylene oxide units.

4. The method according to claim 1, wherein the alkylene oxide units of PAG are solely butylene oxide units.

5. The method according to claim 1, wherein the PAG has a kinematic viscosity measured at 100° C. according to ASTM D445 (2015) between 50 and 500 $mm^2/s$, a kinematic viscosity measured at 40° C. according to ASTM D445 (2015) of between 1000 and 4500 $mm^2/s$, and a viscosity index measured according to ASTM D2270 (2012) between 180 and 300.

6. The method according to claim 1, wherein the lubricating composition comprises at most 30% by weight of PAG.

7. The method according to claim 1, wherein the base oil is selected from Group II oils and Group III oils.

8. The method according to claim 1, wherein the PAG comprises from 50 to 200 moles of butylene oxide units.

9. The method according to claim 1, wherein the PAG comprises an O/C ratio (oxygen atom/carbon atom) by weight/mol between 0.29 and 0.35.

10. The method according to claim 1, wherein the lubricating composition comprises from 6% to 30% by weight of PAG.

11. The method according to claim 1, wherein the lubricating composition comprises from 9% to 16% by weight of PAG.

12. The method according to claim 1, wherein the PAG is obtained by reaction with butylene oxides of diol.

* * * * *